US007926148B2

(12) United States Patent
Saeger et al.

(10) Patent No.: US 7,926,148 B2
(45) Date of Patent: Apr. 19, 2011

(54) APPARATUS FOR THE FIBRE-SORTING OR FIBRE-SELECTION OF A FIBRE BUNDLE COMPRISING TEXTILE FIBRES, ESPECIALLY FOR COMBING

(75) Inventors: Nicole Saeger, Aachen (DE); Johannes Bossmann, Mönchengladbach (DE); Thomas Schmitz, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 376 days.

(21) Appl. No.: 12/163,629

(22) Filed: Jun. 27, 2008

(65) Prior Publication Data

US 2009/0000073 A1 Jan. 1, 2009

(30) Foreign Application Priority Data

Jun. 29, 2007 (DE) ..... 10 2007 030 471
Jun. 29, 2007 (DE) ..... 10 2007 030 472
Jun. 29, 2007 (DE) ..... 20 2007 010 686 U
Jan. 11, 2008 (DE) ..... 10 2008 004 099

(51) Int. Cl.
*D01G 19/00* (2006.01)

(52) U.S. Cl. ..... 19/217

(58) Field of Classification Search ..... 19/115 R, 19/128, 215, 216, 217
See application file for complete search history.

(56) References Cited

U.S. PATENT DOCUMENTS 1,408,780 A * 3/1922 Schleifer ..... 19/217
1,425,059 A * 8/1922 Schleifer ..... 19/217
1,694,432 A * 12/1928 Schleifer ..... 19/217
1,708,032 A * 4/1929 Schleifer ..... 19/217
1,715,473 A * 6/1929 Schleifer ..... 19/217
1,799,066 A * 3/1931 Schleifer ..... 19/217
2,044,460 A 6/1936 Bartram et al.

(Continued)

FOREIGN PATENT DOCUMENTS

DE 367482 1/1923

(Continued)

OTHER PUBLICATIONS

German Patent Office Search Report, dated Aug. 8, 2007, issued in related German Application No. 10 2006 050 384.8, and English language translation of Section C.

(Continued)

*Primary Examiner* — Shaun R Hurley
(74) *Attorney, Agent, or Firm* — Venable LLP; Robert Kinberg; Leigh D. Thelen

(57) ABSTRACT

In an apparatus for the fiber-sorting or fiber-selection a fiber bundle which is supplied by means of a supply device to a fiber-sorting device in which clamping devices are provided which clamp the fiber bundle at a distance from its free end, and in which a mechanical device is present which generates a combing action, for removal of the combed fiber material a revolving element is present. To enable the amount produced per hour (productivity) to be substantially increased in a simple manner and to permit a reliable removal and piecing at high production speed, downstream of the supply device there are arranged at least two rotatably mounted rollers with clamping devices for the fiber, which clamping devices are distributed around the periphery of at least one of the rollers and the device for generating a combing action is associated with a said roller, wherein after take-up of the free regions of the combed fiber bundles by the revolving element, the clamping of the ends of the combed fiber bundles is terminated.

19 Claims, 9 Drawing Sheets

U.S. PATENT DOCUMENTS

Figure 1:
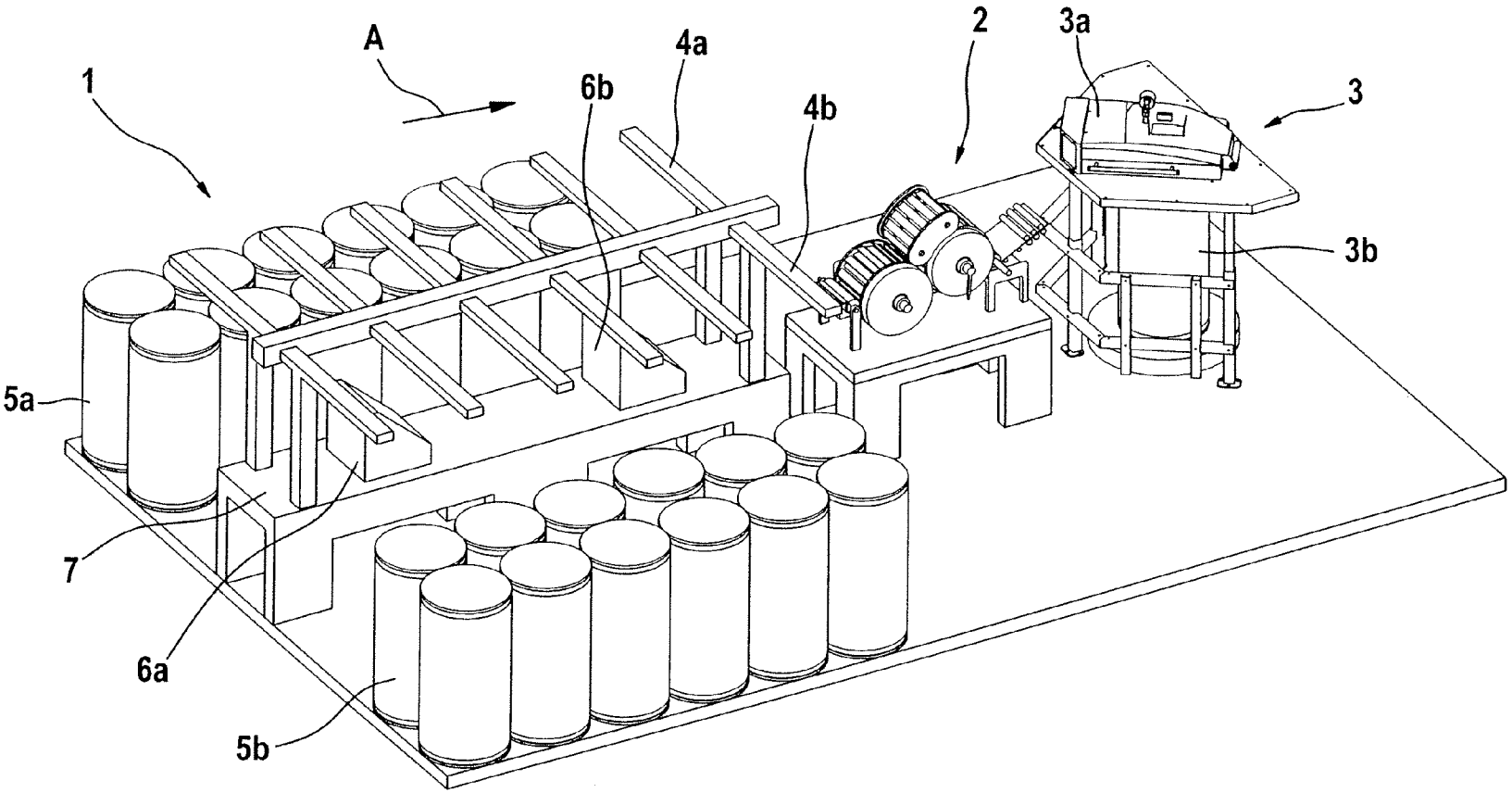

| | | | | |
|---|---|---|---|---|
| 2,962,772 | A | 12/1960 | Draving et al. | |
| 3,108,333 | A * | 10/1963 | Schleifer | 19/235 |
| 4,270,245 | A | 6/1981 | Stewart et al. | |
| 5,007,623 | A | 4/1991 | Unkuri et al. | |
| 5,343,686 | A | 9/1994 | Buchner et al. | |
| 5,404,619 | A | 4/1995 | Jorg | |
| 5,457,851 | A | 10/1995 | Mondini | |
| 5,502,875 | A | 4/1996 | Stolz et al. | |
| 5,796,220 | A | 8/1998 | Clapp et al. | |
| 6,163,931 | A | 12/2000 | Leifeld | |
| 6,173,478 | B1 | 1/2001 | Patelli et al. | |
| 6,216,318 | B1 | 4/2001 | Leifeld | |
| 6,235,999 | B1 | 5/2001 | Rubenach | |
| 6,295,699 | B1 | 10/2001 | Temburg | |
| 6,499,194 | B1 | 12/2002 | Gresser et al. | |
| 6,611,994 | B2 | 9/2003 | Bischofberger et al. | |
| 7,173,207 | B2 | 2/2007 | Losbrock et al. | |
| 2002/0124354 | A1 | 9/2002 | Pferdmenges et al. | |
| 2003/0005551 | A1 | 1/2003 | Schurenkramer et al. | |
| 2003/0029003 | A1 | 2/2003 | Breuer et al. | |
| 2003/0070260 | A1 | 4/2003 | Rubenach | |
| 2003/0154572 | A1 | 8/2003 | Pferdmenges et al. | |
| 2004/0040121 | A1 | 3/2004 | Schmitz | |
| 2004/0128799 | A1 | 7/2004 | Hosel et al. | |
| 2005/0076476 | A1 | 4/2005 | Temburg | |
| 2005/0198783 | A1 | 9/2005 | Rubenach | |
| 2005/0278900 | A1 | 12/2005 | Dammig | |
| 2006/0260100 | A1 | 11/2006 | Duda et al. | |
| 2007/0180658 | A1 | 8/2007 | Saeger et al. | |
| 2007/0180659 | A1 | 8/2007 | Saeger et al. | |
| 2007/0180660 | A1 | 8/2007 | Saeger et al. | |
| 2007/0266528 | A1 | 11/2007 | Farber et al. | |
| 2008/0092339 | A1 | 4/2008 | Bossman et al. | |
| 2009/0000064 | A1 | 1/2009 | Saeger et al. | |
| 2009/0000065 | A1 | 1/2009 | Saeger et al. | |
| 2009/0000066 | A1 | 1/2009 | Saeger et al. | |
| 2009/0000067 | A1 * | 1/2009 | Leder et al. | 19/115 R |
| 2009/0000068 | A1 * | 1/2009 | Saeger et al. | 19/115 R |
| 2009/0000069 | A1 | 1/2009 | Saeger et al. | |
| 2009/0000070 | A1 | 1/2009 | Saeger et al. | |
| 2009/0000071 | A1 | 1/2009 | Saeger et al. | |
| 2009/0000072 | A1 | 1/2009 | Saeger et al. | |
| 2009/0000074 | A1 | 1/2009 | Bossmann | |
| 2009/0000075 | A1 * | 1/2009 | Saeger et al. | 19/115 R |
| 2009/0000076 | A1 | 1/2009 | Bossmann et al. | |
| 2009/0000077 | A1 | 1/2009 | Saeger et al. | |
| 2009/0000078 | A1 | 1/2009 | Saeger et al. | |
| 2009/0000079 | A1 | 1/2009 | Bossmann | |

FOREIGN PATENT DOCUMENTS

| | | | |
|---|---|---|---|
| DE | 382169 | A | 9/1923 |
| DE | 399885 | A | 7/1924 |
| DE | 489 420 | | 1/1930 |
| DE | 30 48 501 | A1 | 7/1982 |
| DE | 103 20 452 | A1 | 11/2004 |
| EP | 1 586 682 | A1 | 10/2005 |
| WO | WO 2006/012758 | A1 | 2/2006 |

OTHER PUBLICATIONS

German Patent office Search Report, dated Jul. 10, 2007 Issued in German Patent Application No. 10 2006 050 453.4, and partial English-language translation.

U.S. Office Action dated Feb. 26, 2010, issued in related U.S. Appl. No. 12/149,506.

* cited by examiner

APPARATUS FOR THE FIBRE-SORTING OR FIBRE-SELECTION OF A FIBRE BUNDLE COMPRISING TEXTILE FIBRES, ESPECIALLY FOR COMBING

CROSS REFERENCE TO RELATED APPLICATION

This application claims priority from German Patent Application Number 10 2007 030 472.4 dated Jun. 29, 2007, German Utility Model Application No. 20 2007 010 686.6 dated Jun. 29, 2007, and German Patent Application Number 10 2008 004 099.1 dated Jan. 11, 2008, the enclosure of each of which is incorporated herein by reference.

BACKGROUND OF THE INVENTION

The invention relates to an apparatus for the fibre-sorting or fibre-selection of a fibre bundle comprising textile fibres, especially for combing.

In certain known apparatus, fibre bundles are supplied by means of a supply device to a fibre-sorting device, especially to a combing device, in which clamping devices are provided, which clamp the fibre bundle at a distance from its free end, and mechanical means are present which generate a combing action from the clamping site to the free end of the fibre bundle, a circulating means for removing the combed fibre material being present, which is provided on its periphery with air-permeable openings and at least part of the inner space of which is connected to a source of reduced pressure.

In practice, combing machines are used to free cotton fibres or woollen fibres of natural impurities contained therein and to parallelise the fibres of the fibre sliver. For that purpose, a previously prepared fibre bundle is clamped between the jaws of the nipper arrangement so that a certain sub-length of the fibres, known as the "fibre tuft", projects at the front of the jaws. By means of the combing segments of the rotating combing roller, which segments are filled with needle clothing or toothed clothing, this fibre tuft is combed and thus cleaned. The take-off device usually consists of two counter-rotating rollers, which grip the combed fibre tuft and carry it onwards. The known cotton-combing process is a discontinuous process. During a nipping operation, all assemblies and their drive means and gears are accelerated, decelerated and in some cases reversed again. High nip rates result in high acceleration. Particularly as a result of the kinematics of the nippers, the gear for the nipper movement and the gear for the pilgrim-step movement of the detaching rollers, high acceleration forces come into effect. The forces and stresses that arise increase as the nip rates increase. The known flat combing machine has reached a performance limit with its nip rates, which prevents productivity from being increased. Furthermore, the discontinuous mode of operation causes vibration in the entire machine, which generates dynamic alternating stresses.

WO 2006/012758 A discloses a combing machine, in which a fibre bundle drawn off by two draw-off rollers is supplied discontinuously to a downstream perforated drum under the influence of an air current and is added to the fibre web already formed (piecing). The leading end of the fibre web conveyed by the draw-off rollers is pushed in this process towards the perforated drum. The perforated drum also performs a clockwise rotation. Inside the perforated drum there is arranged a rotatable cylinder with two openings, which, in conjunction with the rotary movement of the cylinder, ensure that the leading end of the fibre bundle is deflected in the direction of rotation of the perforated drum, whilst the trailing end of the fibre bundle, after the draw-off rollers have released it, is deposited on the perforated drum. The disadvantage is the high expenditure on equipment. In particular it is a disadvantage that a high production is not possible. The rotational speed of the draw-off rollers that convey the fibre bundle is adapted to the upstream slow combing process and is limited by this. A further drawback is that each fibre bundle is clamped and conveyed by the draw-off roller pair. The clamping point changes constantly owing to the rotation of the draw-off rollers, i.e. there is a constant relative movement between the rollers effecting clamping and the fibre bundle. All the fibre bundles have to pass in succession through a draw-off roller pair, which represents a further considerable limitation of the production speed.

SUMMARY OF THE INVENTION

It is an aim of the invention to provide an apparatus of the kind described at the beginning which avoids or mitigates the mentioned disadvantages and which in a simple way, in particular, enables the amount produced per hour (productivity) to be substantially increased and a reliable take-off and piecing at higher production speed.

The invention provides an apparatus for the fibre-sorting or fibre-selection of a fibre bundle comprising textile fibres having:

a fibre-sorting device in which clamping devices are provided which each clamp the fibre bundle fibres at a distance from its free end;

a supply device for supplying the fibre bundle to the fibre-sorting device;

at least one mechanical device for generating a combing action from the clamping site to the free end of the fibre bundle; and a piecing arrangement for removing the combed fibre bundles comprising a revolving element;

wherein the fibre-sorting device comprises, arranged downstream of the supply device, at least two rotatably mounted rollers that, in use, rotate rapidly without interruption, said clamping devices being distributed spaced apart in the region of at least one said roller's periphery, and the device for generating a combing action is associated with at least one of said rollers, and wherein the arrangement is such that, after take-up of the free regions of the combed fibre bundles by the revolving element, the clamping of the clamped ends of the combed fibre bundles is releasable.

By implementing the functions of clamping and moving the fibre bundles to be combed-out on rotating rollers, preferably a turning rotor and a combing rotor, high operating speeds (nip rates) are achievable—unlike the known apparatus—without large mass accelerations and reversing movements. In particular, the mode of operation is continuous. When high-speed rollers are used, a very substantial increase in hourly production rate (productivity) is achievable, which had previously not been considered possible in technical circles. A further advantage is that the rotary rotational movement of the rollers with the plurality of clamping devices leads to an unusually rapid supply of a plurality of fibre bundles per unit of time to the take-off roller. In particular the high rotational speed of the rollers allows production to be substantially increased. To form the fibre bundle (also referred to herein as "fibre tuft"), the fibre sliver pushed forward by the feed roller is clamped at one end by a clamping device and detached by the rotary movement of the turning rotor. The clamped end contains short fibres, the free region comprises the long fibres. The long fibres are pulled by separation force out of the fibre material clamped in the feed nip, short fibres remaining behind through the retaining force in the feed nip. Subsequently, as the fibre bundle is transferred from the turning rotor onto the combing rotor the ends of the fibre bundle are reversed: the clamping device on the combing rotor grips and clamps the end with the long fibres, so that the region with the short fibres projects from the clamping device and lies exposed and can thereby be combed out.

The fibre bundles are—unlike the known apparatus—held by a plurality of clamping devices and transported under rotation. The clamping point at the particular clamping devices therefore remains substantially constant on each roller until the fibre bundles are transferred to the subsequent roller or take-off roller. A relative movement between clamping device and fibre bundle does not begin until after the fibre bundle has been gripped by the subsequent roller, especially take-off roller (piecing roller), and in addition clamping has been terminated. Because a plurality of clamping devices is available for the fibre bundles, in an especially advantageous manner fibre bundles can be supplied to the piecing roller one after the other and in quick succession, without undesirable time delays resulting from just a single supply device.

The revolving element of the piercing arrangement preferably defines an inner region, at least a sub-region of which is connected to a source of reduced pressure, for example, a source of suction. In certain preferred embodiments, the revolving means is a rotatable take-off roller, for example, a rotatable perforated drum. Advantageously, the cylindrical surface of the take-off roller, perforated drum or the like has air-passage openings. Advantageously, means are provided to control and adjust the speed of rotation of the perforated drum. Advantageously, means are provided to control the speed of rotation of the roller with the clamping devices. Advantageously, the delivery of the fibre bundles from the clamping devices of the roller and the take-up of the fibre bundles onto the take-off roller are synchronised. In use, a fibre tuft combed with combing segments, e.g. a circular comb, card top, is advantageously suppliable to the piecing roller. Advantageously, as it is supplied to the piecing roller, the fibre tuft is in a fixed position as it moves towards the clamping site. Advantageously, the clamped fibre tuft is movable in rotation about the rotor axis in the direction of flow of the material. Advantageously, a relative movement between clamping elements and fibre bundle does not begin until after the fibre bundle has been taken up by the piecing roller and in addition clamping has been terminated. Advantageously, the point in time of termination of the clamping forces on the fibre bundle is adjustable. Advantageously, through the point in time of termination of the clamping forces of the fibre bundle, the tension draft of the fibre bundle on deposition onto the piecing roller is adjustable. Advantageously, a smooth and/or stretched-out deposition is possible. Advantageously, the cylindrical surface of the take-off roller contains air passage openings. Advantageously, the revolving element, for example piecing roller, is connected to a source of reduced pressure, which is advantageously adjustable. Advantageously, the piecing roller is acted upon by suction continuously (not in timed mode).

Where, as is preferred, the revolving element is a piecing roller, the piecing roller is advantageously rotatably mounted axially parallel to the combing rotor. Advantageously, the piecing roller is mounted on a concentric path with respect to the combing rotor axis. Advantageously, the distance of the piecing roller from the combing rotor is adjustable. Advantageously, the direction of rotation of the piecing roller can be set to be the same as, or counter to the adjacent roller of the fibre-sorting device, which in practice will advantageously be a combing rotor. Advantageously, the circumferential speed of the piecing roller is adjustable. Advantageously, the combed fibre bundles are overlapping on the piecing roller (piecing operation). Advantageously, the overlap length is adjustable dependent on the relative speed between piecing roller and combing rotor. Advantageously, by varying the overlap length the web weight and the evenness (CV) is alterable. The variation of the overlap length can advantageously be effected in adaptation to the fibre material. Advantageously, through variation between same-direction and counter-direction piecing the hooked fibre direction (leading and trailing hooked fibres) is alterable. The variation between same-direction and counter-direction piecing may be determinable depending on requirements.

Advantageously, a portion of the inner circumferential surface of the piecing roller is sealable by a screen element. Advantageously, the spacing of the screen elements from the piecing roller in the radial direction is small, e.g. 0.2 to 0.4 mm. In some embodiments, slide ring seals are provided, so that no spacing is present.

Advantageously, web-consolidation elements co-operate with the piecing roller. Advantageously, the web-consolidation elements are positioned between the transfer point from combing rotor onto the piecing roller and the transfer point from the piecing roller to the point at which the material is taken down from the piecing roller. Advantageously, at least one web-consolidation element is usable. In certain embodiments, when using a plurality of web-consolidation elements, the spacing of the elements with respect to the piecing roller becomes continuously smaller in the direction of flow of the material. Where present, at least one web-consolidation element is selected from rotatable pressure-applying rollers and revolving belts or the like. Clothings may be arranged on the surface of the at least one web-consolidation element. The surface of the at least one web-consolidation element may be profiled, e.g. milled. The surface of the at least one web-consolidation element may be rubberised. In some embodiments, the at least one web-consolidation element may be a solid roller. Where present, the at least one web-consolidation element may advantageously have the same circumferential speed as the piecing roller. Advantageously, the outer cylindrical surface of the piecing roller is provided with covering elements, casings or the like. Advantageously, the covering elements, casings or the like are positioned in the reduced pressure region in order to reduce the volume of air required. Advantageously, the covering elements, casings or the like or parts of the casings are of antistatic construction. It is preferred that air guide openings are provided at the outer cylindrical surface of the piecing roller. For example, there may be air guide elements mounted in the nip region between combing rotor and piecing roller. As well or instead, air guide elements may be arranged in relation to the piecing roller periphery at the point of removal of the fibre material from the piecing roller and/or air guide elements may be mounted between the covering elements and the piecing roller. The removal of the fibre from the piecing roller may be effected by any suitable means, for example, via strippers, blades or the like, by means of at least one roller pair, by means of a negative pressure roller, by means of a roller with a defined clamping line with respect to the piecing roller, by means of an overpressure region in the piecing roller, or by means by of nozzles through which air flows, with which the web is separable from the piecing roller.

Advantageously, a drafting device is arranged downstream of the piecing roller. The drafting device may be a regulated drafting device or an unregulated drafting device. Preferably, there is generated a fibre web or sliver that is drawable. Advantageously, an apparatus for extending the width of a fibre web is present upstream of the drafting system. Advantageously, an apparatus for extending the width of a fibre sliver is present upstream of the drafting system. Advantageously, a sliver-forming device is arranged downstream of the piecing roller. Advantageously, a sliver-deposition device is arranged downstream of the piecing roller.

Where there are elements associated with the piecing roller, for example, covering elements, air guide elements, screen elements, web-consolidation elements and the like, those are advantageously so arranged that they are exchangeable. Advantageously, the elements associated with the piecing roller, for example, covering elements, air guide elements, screen elements, web-consolidation elements and the like, are adjustable as regards their position with respect to the piecing roller. In some embodiments, the piecing roller is in the form of a perforated conveyor belt and is connected to a source of reduced pressure. In that case, depending on the geometrical configuration of the conveyor belt, the removal region is positioned closer to the combing rotor than when using a piecing roller. Advantageously, depending on the geometrical configuration of the conveyor belt, a relatively long transfer region is present between the combing rotor and the conveyor belt, which is used as piecing roller. Preferably, two belt guide rollers are present, which are positioned at the rotor periphery.

Advantageously, the free regions of the combed fibre slivers are aligned against the direction of rotation of the rollers, that is the turning rotor and the combing rotor. In certain embodiments, the free regions of the combed fibre bundles are aligned in the direction of rotation of the piecing roller. In other embodiments, the free regions of the combed fibre bundles are aligned against the direction of rotation of the piecing roller. Advantageously, the turning rotor and the combing rotor have opposite directions of rotation. Advantageously, for the suction of the supplied fibre bundles, at least one suction device is associated with the clamping devices in the region of the transfer of the fibre bundle from the supply device to the first roller and/or in the region of the transfer of the fibre material from the first roller to the second roller.

The invention also provides an apparatus for the fibre-sorting or fibre-selection of a fibre bundle comprising textile fibres, especially for combing, which is supplied by means of supply means to a fibre-sorting device, especially a combing device, in which clamping devices are provided which clamp the fibre bundle at a distance from its free end, and mechanical means are present which generate a combing action from the clamping site to the free end of the fibre bundle, wherein in order to remove the combed fibre material a revolving means (piecing element) is present, which is provided on its periphery with air-permeable openings and at least one subregion of the inner space is connected to a source of reduced pressure, characterised in that downstream of the supply means there is arranged at least one rotatably mounted roller rotating rapidly without interruption which is provided with clamping devices for the fibre slivers transported in rotation, which clamping devices are distributed spaced apart in the region of its periphery, and the means for generating a combing action (combing elements) are associated with the roller, wherein after take-up of the free regions of the combed fibre slivers by the revolving means (piecing element), the clamping of the clamped ends of the combed fibre slivers is releasable.

BRIEF DESCRIPTIONS OF THE DRAWINGS

Figure 2:
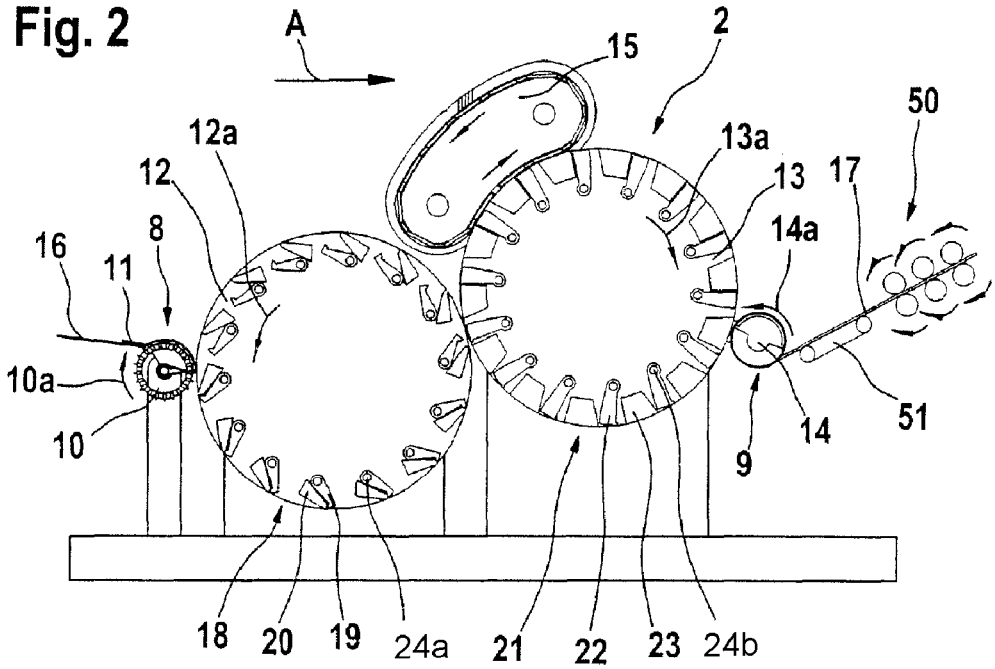
Figure 3:
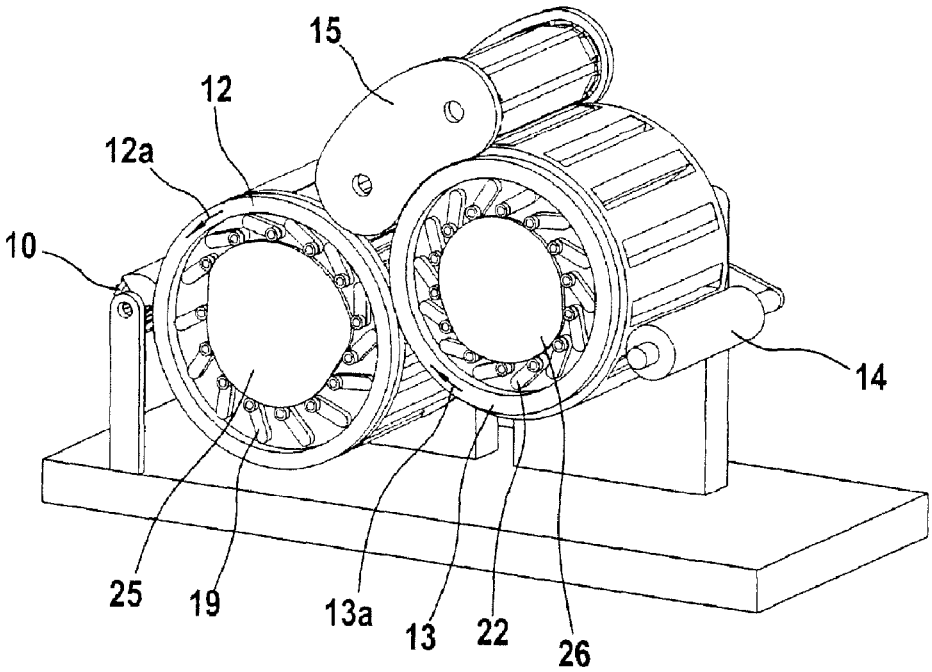
Figure 4A:
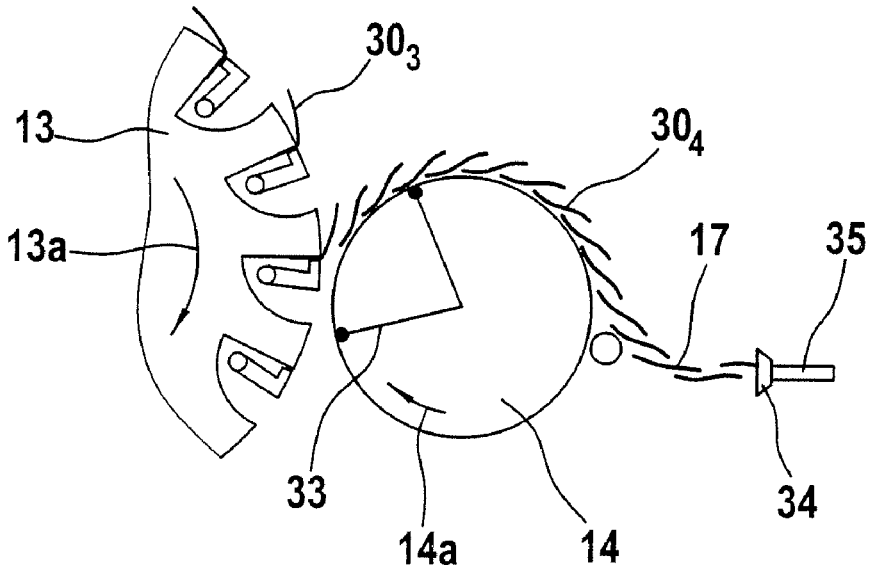
Figure 4B:
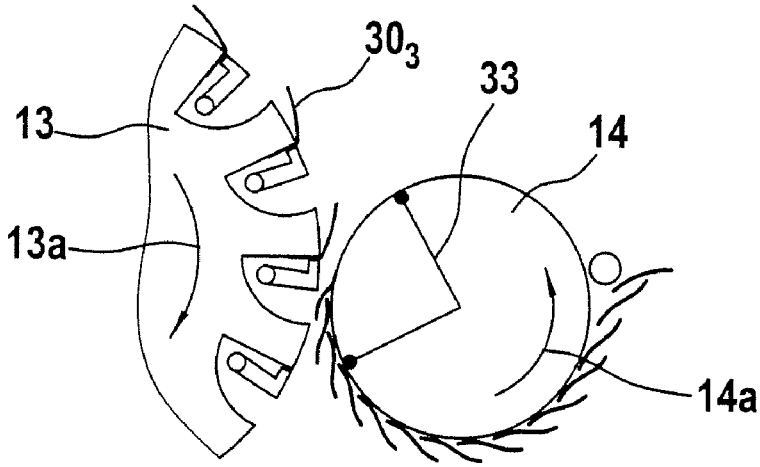
Figure 5A:
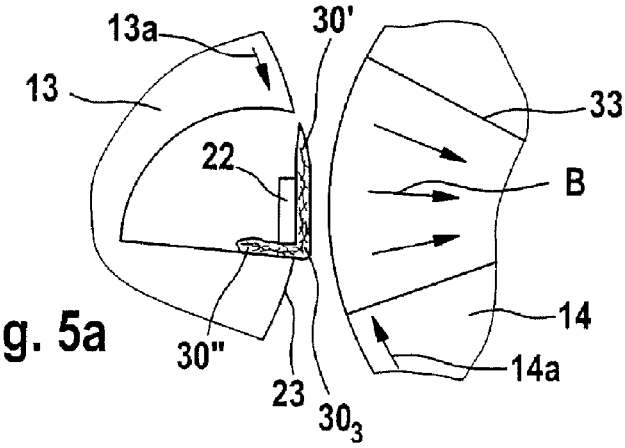
Figure 5B:
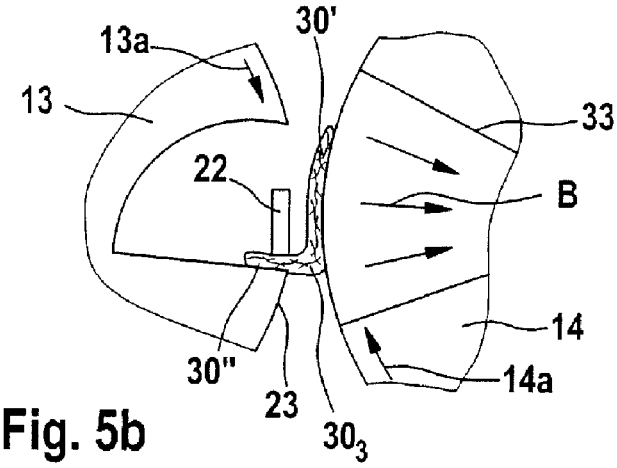
Figure 5C:
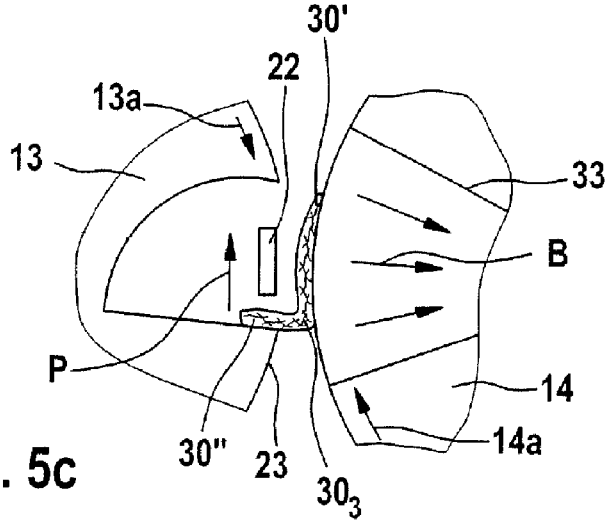
Figure 6:
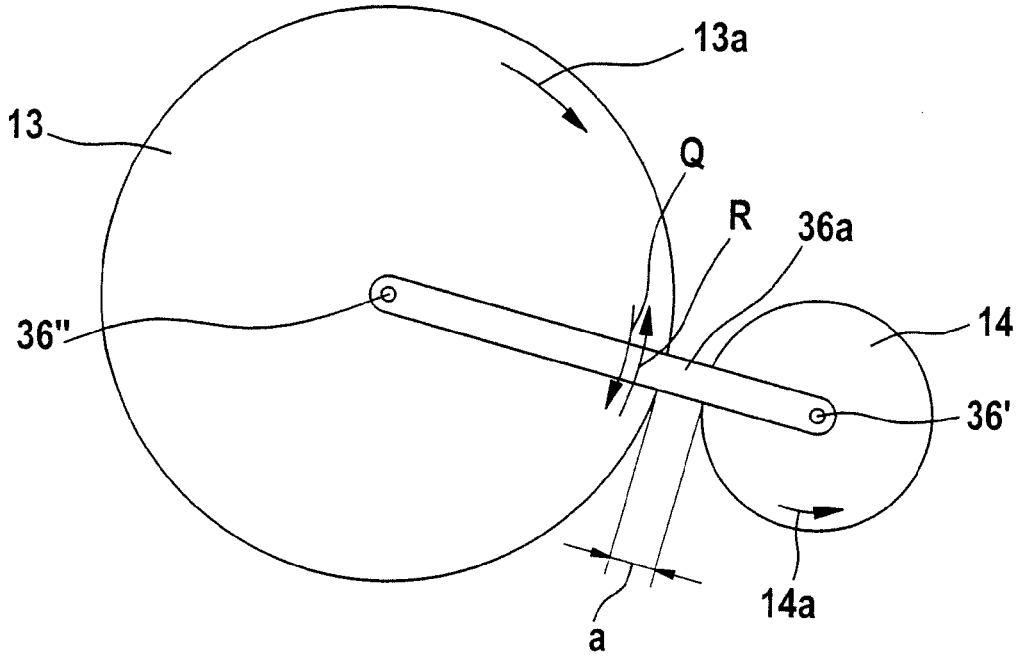
Figure 7A:
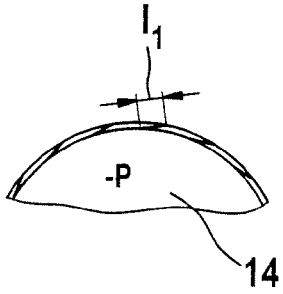
Figure 7B:
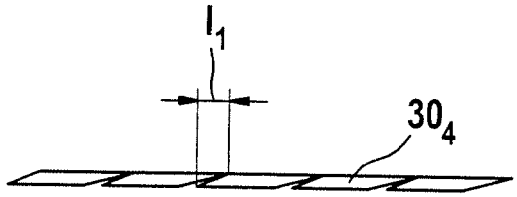
Figure 7C:
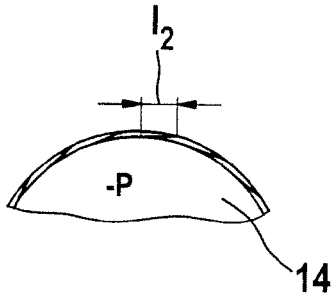
Figure 7D:
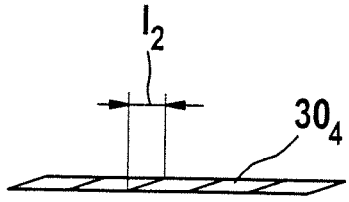
Figure 8:
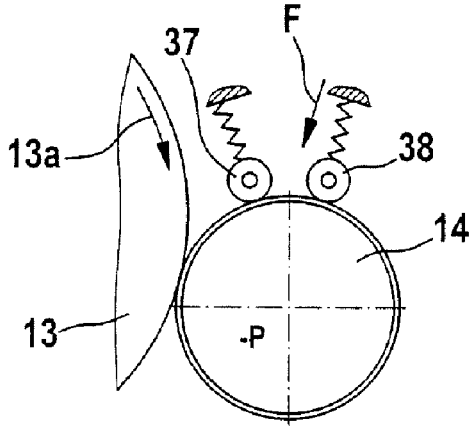
Figure 9:
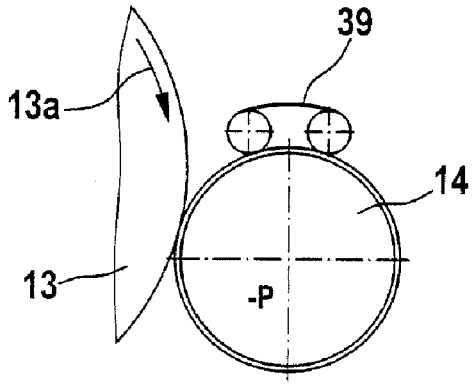
Figure 10:
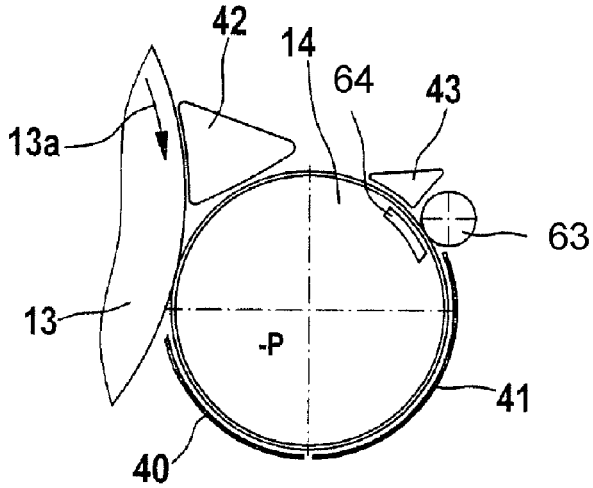
Figure 11:
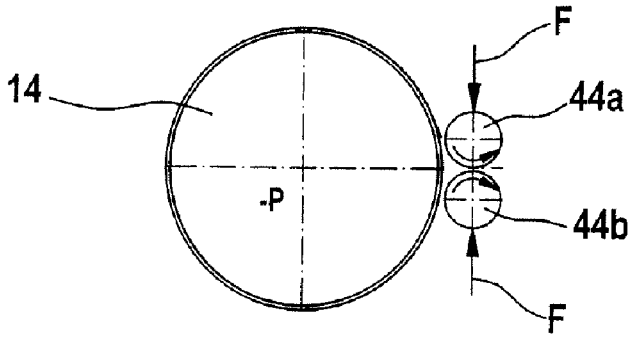
Figure 12:
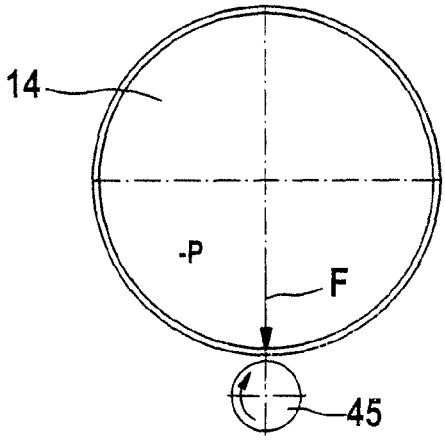
Figure 13:
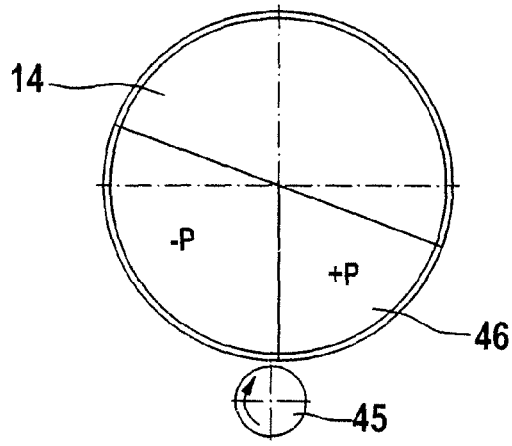
Figure 14:
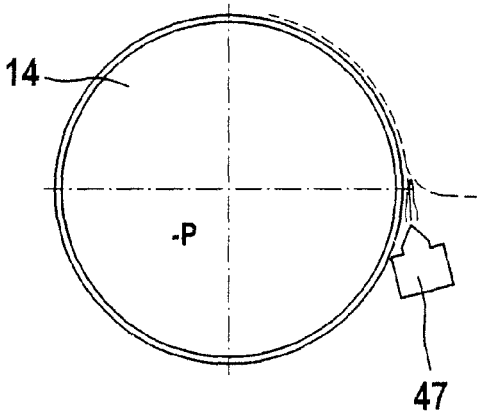
Figure 15:
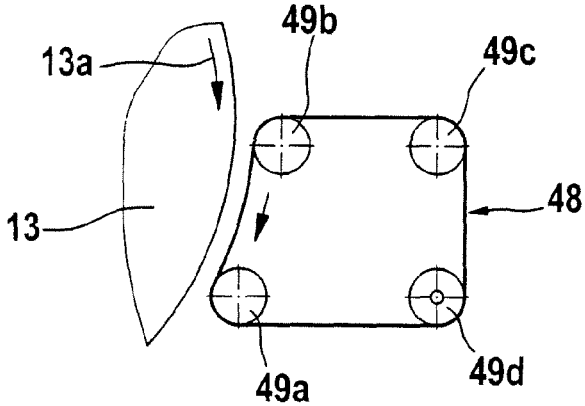
Figure 16:
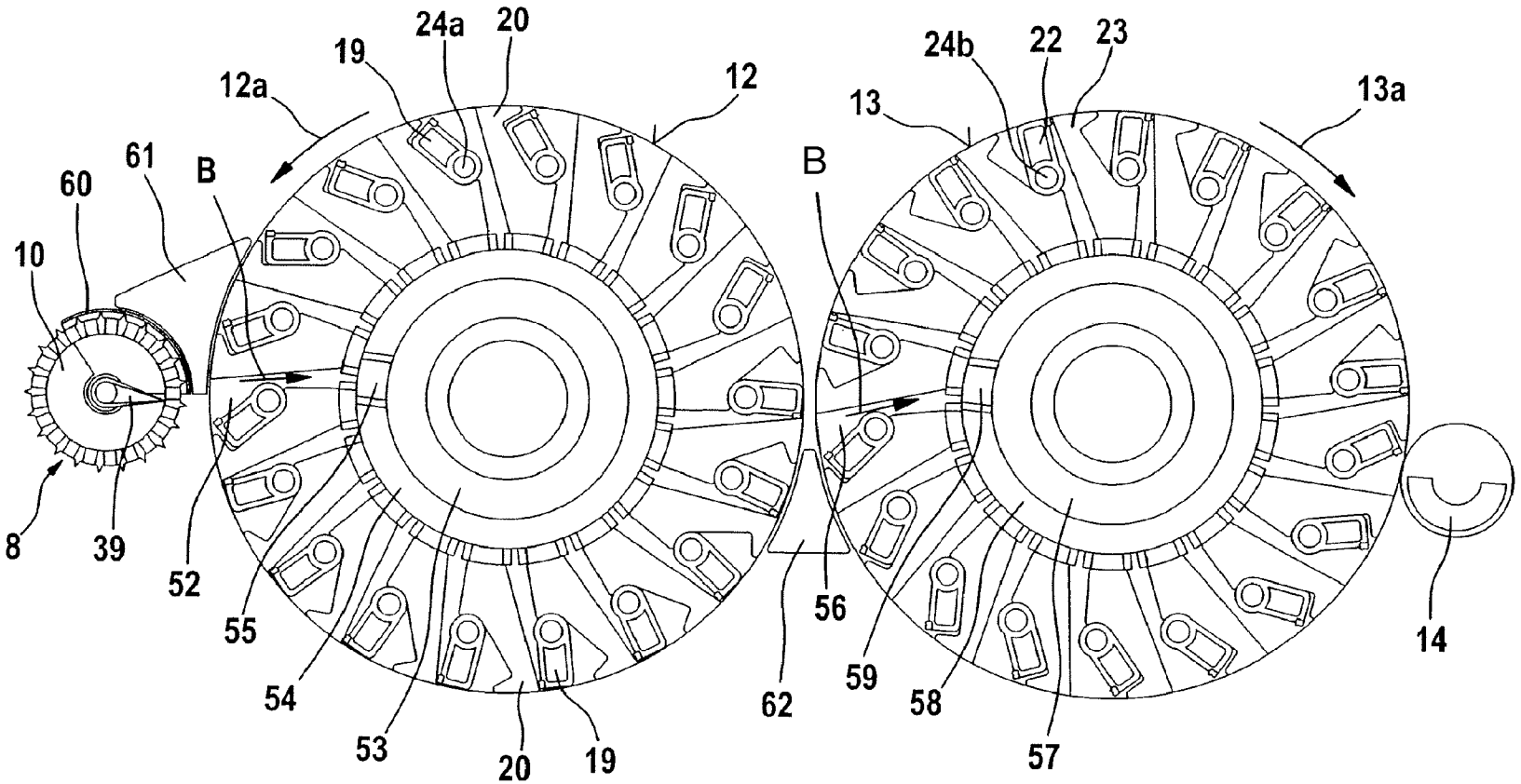
Figure 17:
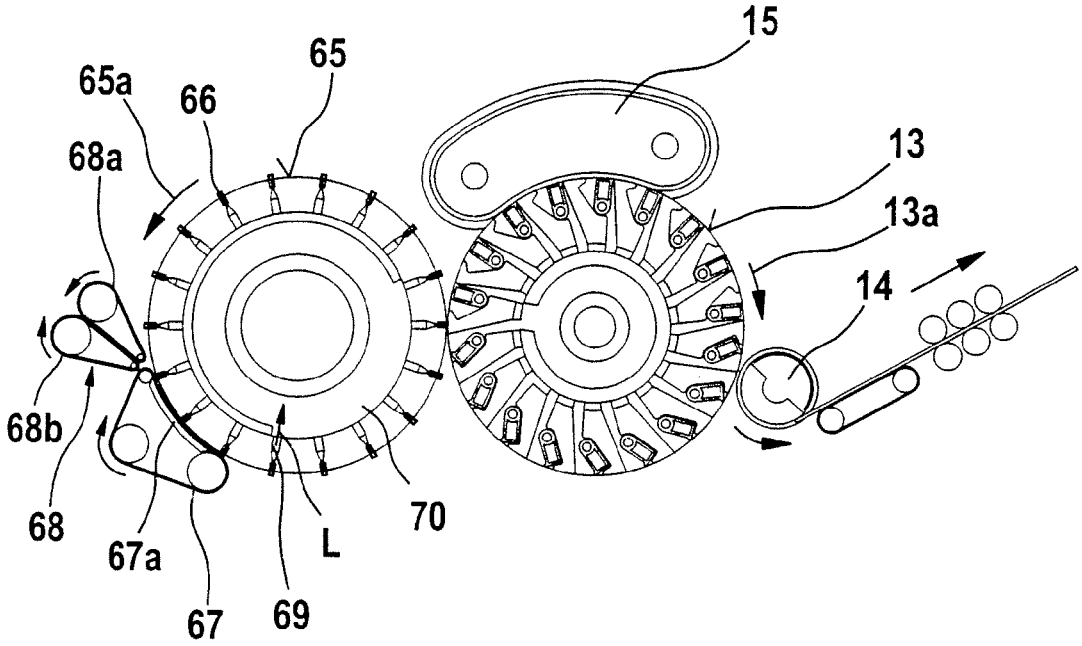
Figure 18:
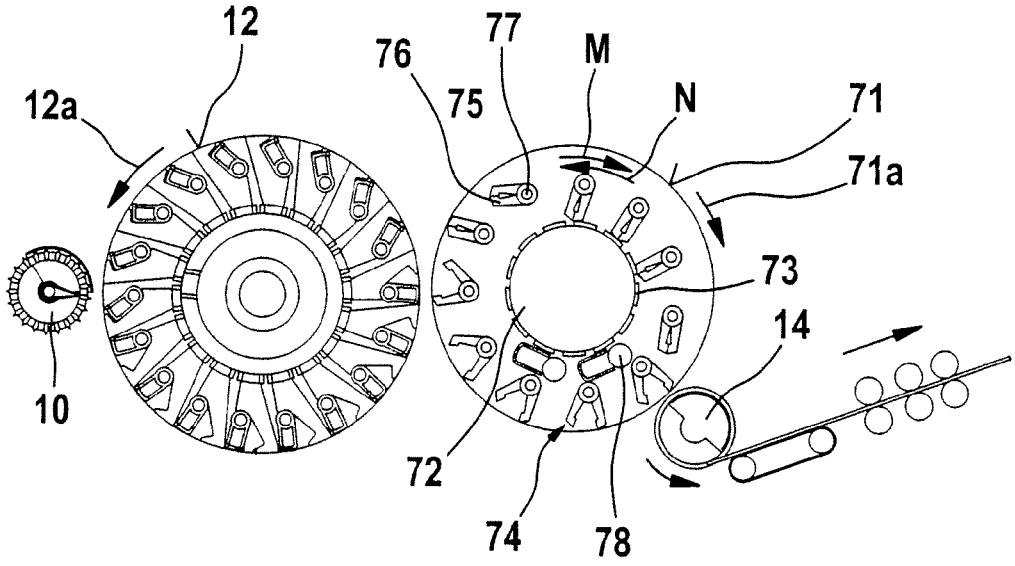

FIG. 1 is a diagrammatic perspective view of a device for combing fibre material, comprising a combing preparation device, a rotor combing machine and a sliver-deposition device, FIG. 2 is a diagrammatic side view of a rotor combing machine according to the invention having two rollers, FIG. 3 is a perspective view of a rotor combing machine constructed as shown in FIG. 2 and further having two cam discs, FIGS. 4*a*, 4*b* show embodiments of the invention in which the second roller (combing rotor) and the take-off roller are arranged for counter-direction piecing (FIG. 4*a*) and same-direction piecing (FIG. 4*b*), respectively, FIGS. 5*a* to 5*c* show in diagrammatic form the operating sequence during delivery of a combed fibre bundle onto and take-up of the combed fibre bundle by the take-off roller acted upon by suction, FIG. 6 shows an embodiment of the invention in which a piecing roller is mounted on a path concentric with respect to the combing rotor axis, FIGS. 7*a* and 7*b*, 7*c* and 7*d* are illustrations of variable overlap lengths, dependent on the relative speed between piecing roller and combing rotor, FIG. 8 shows two pressure rollers as web-consolidation elements associated with a the piecing roller, FIG. 9 shows an endlessly revolving belt as web-consolidation element associated with a piecing roller, FIG. 10 shows a screen element, cover elements/claddings and air guide elements associated with a piecing roller, FIG. 11 shows the removal of the fibre material from a piecing roller by means of a roller pair, FIG. 12 shows the removal of the fibre material from a piecing roller by means of defined clamping line with respect to the piecing roller, FIG. 13 shows the removal of the fibre material from a piecing roller by means of an overpressure region, FIG. 14 shows the removal of the fibre material from a piecing roller by means of nozzles, through which air flows, FIG. 15 shows a conveyor belt as piecing element associated with a combing rotor, FIG. 16 a rotor combing machine similar to that shown in FIG. 2, in which suction devices are associated with the clamping devices, FIG. 17 is a diagrammatic side view of a further embodiment of the rotor combing machine according to the invention, in which counter-elements are arranged opposite the first roller (turning rotor) and the fibre bundle (fibre portion) is acted upon by suction, and FIG. 18 is a diagrammatic side view of another embodiment of the rotor combing machine according to the invention, in which the combing elements are arranged inside the combing rotor.

DETAILED DESCRIPTION OF CERTAIN PREFERRED EMBODIMENTS

With reference to FIG. 1, a combing preparation machine 1 has a sliver-fed and lap-delivering spinning room machine and two feed tables 4*a*, 4*b* (creels) arranged parallel to one another, there being arranged below each of the feed tables 4*a*, 4*b* two rows of cans 5*a*, 5*b* containing fibre slivers (not shown). The fibre slivers withdrawn from the cans 5*a*, 5*b* pass, after a change of direction, into two drafting systems 6*a*, 6*b* of the combing preparation machine 1, which are arranged one after the other. From the drafting system 6*a*, the fibre sliver web that has been formed is guided over the web table 7 and, at the outlet of the drafting system 6*b*, laid one over the other and brought together with the fibre sliver web produced therein. By means of the drafting systems 6*a* and 6*b*, in each case a plurality of fibre slivers are combined to form a lap and drafted together. A plurality of drafted laps (two laps in the example shown) are doubled by being placed one on top of the other. The lap so formed is introduced directly into the supply device (feed element) of the downstream rotor combing machine 2. The flow of fibre material is not interrupted. The combed fibre web is delivered at the outlet of the rotor combing machine 2, passes through a funnel (see FIG. 10*a*), forming a comber sliver, and is deposited in a downstream sliver-deposition device 3. Reference numeral A denotes the operating direction.

An autoleveller drafting system 50 (see FIG. 2) can be arranged between the rotor combing machine 2 and the sliver-deposition device 3. The comber sliver is thereby drafted.

In accordance with a further embodiment, more than one rotor combing machine 2 is provided. If, for example, two rotor combing machines 2*a* and 2*b* are present, then the two delivered comber slivers 17 can pass together through the downstream autoleveller drafting system 50 and be deposited as one drafted comber sliver in the sliver-deposition device 3.

The sliver-deposition device 3 comprises a rotating coiler head 3*a*, by which the comber sliver can be deposited in a can 3*b* or (not shown) in the form of a can-less fibre sliver package.

FIG. 2 shows a rotor combing machine 2 having a supply device 8 comprising a feed roller 10 and a feed tray 11, having a first roller 12 (turning rotor), second roller 13 (combing rotor), a take-off device 9 comprising a take-off roller 14 and a revolving card top combing assembly 15. The directions of rotation of the rollers 10, 12, 13 and 14 are shown by curved arrows 10*a*, 12*a*, 13*a* and 14*a*, respectively. The incoming fibre lap is indicated by reference numeral 16 and the delivered fibre web is indicated by reference numeral 17. The rollers 10, 12, 13 and 14 are arranged one after the other. Arrow A denotes the operating direction.

The first roller 12 is provided in the region of its outer periphery with a plurality of first clamping devices 18 which extend across the width of the roller 12 (see FIG. 3) and each consist of an upper nipper 19 (gripping element) and a lower nipper 20 (counter-element). In its one end region facing the centre point or the pivot axis of the roller 12, each upper nipper 19 is rotatably mounted on a pivot bearing 24*a*, which is attached to the roller 12. The lower nipper 20 is mounted on the roller 12 so as to be either fixed or movable. The free end of the upper nipper 19 faces the periphery of the roller 12. The upper nipper 19 and the lower nipper 20 co-operate so that they are able to grip a fibre bundle 16 (clamping) and release it.

The second roller 13 is provided in the region of its outer periphery with a plurality of two-part clamping devices 21, which extend across the width of the roller 13 (see FIG. 3) and each consist of an upper nipper 22 (gripping element) and a lower nipper 23 (counter-element). In its one end region facing the centre point or the pivot axis of the roller 13, each upper nipper 22 is rotatably mounted on a pivot bearing 24*b*, which is attached to the roller 13. The lower nipper 23 is mounted on the roller 13 so as to be either fixed or movable. The free end of the upper nipper 22 faces the periphery of the roller 13. The upper nipper 22 and the lower nipper 23 co-operate so that they are able to grip a fibre bundle $\mathbf{30}_3$ (clamping) and release it (FIGS. 5*a* to 5*c*). In the case of roller 12, around the roller periphery between the feed roller 10 and the second roller 13 the clamping devices 18 are closed (they clamp fibre bundles (not shown) at one end) and between the second roller 13 and the feed roller 10 the clamping devices 18 are open. In roller 13, around the roller periphery between the first roller 12 and the doffer 14 the clamping devices 21 are closed (they clamp fibre bundles (not shown) at one end) and between the doffer 14 and the first roller 12 the clamping devices 21 are open. Reference numeral 50 denotes a drafting system, for example an autoleveller drafting system. The drafting system 50 is advantageously arranged above the coiler head 3*a*. Reference numeral 51 denotes a driven ascending conveyor, for example a conveyor belt. It is also possible to use an upwardly inclined metal sheet or the like for conveying purposes.

In the embodiment of FIG. 3, two fixed cam discs 25 and 26 are provided, about which the roller 12 having the first clamping devices 18 and the roller 13 having the second clamping devices 21 are rotated in the direction of arrows 12*a* and 13*a*, respectively. The loaded upper nippers 19 and 22 are arranged in the intermediate space between the outer periphery of the cam discs 25, 26 and the inner cylindrical surfaces of the rollers 12, 13. By rotation of the rollers 12 and 13 about the cam discs 25 and 26, the upper nippers 19 and 22 are rotated about pivot axes 24*a* and 24*b*, respectively. In that way, the opening and closing of the first clamping devices 18 and the second clamping devices 21 is implemented.

In an embodiment shown in FIG. 4*a*, the directions of rotation 13*a* and 14*a* of the roller 13 and the doffer 14 are the same (both clockwise). As a result, counter-direction piecing is implemented. The combed fibre bundles $\mathbf{30}_4$ are placed one over the other in the manner of roof tiles on the cylindrical surface of the doffer. In the interior of the doffer 14 there is a fixed screen element 33. The cylindrical surface of the doffer 14 has air-permeable openings. By applying a reduced pressure −p in the space between the screen element 33 and the inner cylindrical surface, the fibre bundles $\mathbf{30}_3$ are sucked from the roller 13 onto the outer cylindrical surface of the doffer 14. Outside the screen element 33, that is to say in the region without a reduced pressure, the fibre bundles $\mathbf{30}_4$ can be detached from the outer cylindrical surface of the doffer 14.

In a further embodiment shown in FIG. 4*b*, the directions of rotation 13*a* and 14*a* of the roller 13 and the doffer 14 are opposite to one another. As a result, same-direction piecing is implemented. The combed fibre bundles $\mathbf{30}_3$ are removed from the roller 13 by the doffer 14 in substantially the same way as that described with reference to the construction according to FIG. 4*a*. Downstream of the doffer 14 there is a sliver funnel 34 into which the overlapping fibre bundles $\mathbf{30}_4$ enter and emerge or are withdrawn as a combed sliver 35.

By variation between same-direction piecing (FIG. 4*b*) and counter-direction piecing, the hooked fibre direction (leading and trailing fibre hooks) is altered and can be determined according to requirements.

A portion of the inner cylindrical surface of the piecing roller 14 can be sealed by the screen element 33.

The spacing of the screen elements 33 from the piecing roller 14 should be as small as possible, e.g. 0.3 mm in the radial direction. When using slide seal rings, a spacing of 0 mm is possible.

In respect of the mode of operation and operating sequence of an illustrative apparatus according to the invention:

Lap Preparation

A plurality of slivers is combined to form a lap 16 and drafted together. A plurality of laps 16 can be doubled by being placed one on top of the other. The resulting lap 16 is introduced directly into the feed element 10 of the rotor combing machine 2. The flow of material is not interrupted by forming a wound lap.

Feed

Unlike a flat combing machine, the upstream lap 16 is fed continuously by means of a conveyor element. The feed quantity is determined by the length of lap 16 conveyed between two closure time points of the nippers 18 (reversing nippers) of the first rotor 12 (turning rotor).

Clamping 1

The fibre tuft aligned and projecting out of the lap 16 is clamped by a clamping device 18 (reversing nipper) of the first rotor 12 (turning rotor). The clamping device 18 of the first rotor 12 assumes the function of detachment.

Removal

As a result of the rotation of the turning rotor 12 with the reversing nippers 18 located thereon, the clamped fibre tuft is removed from the feed lap, it being necessary for a retaining force to act on the lap 16 so that the fibres in the lap 16 not clamped by the reversing nipper 8 are retained. The retaining force is applied by the conveyor element of the feed means or by additional means such as a feed tray or a top comb. The elements that generate the retaining force assume the function of the top comb.

Clamping 2

The fibre tuft is aligned and transferred to the clamping nipper 21 (combing nipper) of the second rotor 13 (combing rotor). The distance between the reversing nipper clamping line and the combing nipper clamping line at the time the combing nipper 21 closes determines the ecartement.

Combing

The fibre tuft projecting out of the combing nipper 21 contains non-clamped fibres that are eliminated by means of combing.

Delivery Onto and Take-up by the Take-off Roller (Piecing Roller)

FIGS. 5*a* to 5*c* illustrate diagrammatically a typical operating sequence on delivery of the combed-out fibre bundle $\mathbf{30}_3$ from the roller 13 onto the take-off roller 14 acted upon by suction and the take-up of the combed-out fibre bundle $\mathbf{30}_3$ from the roller 13 by the take-off roller 14 acted upon by suction, the Figures showing one after the other in chronological order: according to FIG. 5*a*, transport of the fibre bundle $\mathbf{30}_3$ by the roller 13 in direction 13*a* into the suction region of the take-off roller 14, with the clamped end 30" of the combed fibre bundle $\mathbf{30}_3$ being clamped by the closed clamping device 21 comprising upper nipper 22 and lower nipper 23. According to FIG. 5*b*, suction of the free end 30' by the take-off roller 14 and placement of the free end 30' on the outer surface of the take-off roller 14, with continued clamping of the clamped end 30". According to FIG. 5*c*, termination of the clamping of the clamped end 30" by opening of the clamping device 21, that is to say lifting of the upper nipper 22 in direction P away from the lower nipper 23. FIGS. 5*a* to 5*c* show the removal of the fibre bundle $\mathbf{30}_3$ during counter-direction piecing (see FIG. 4*a*). Reference letter B denotes suction currents.

Piecing

The combed-out fibre tuft $\mathbf{30}_3$ is deposited on a take-off roller 14. The surface of the take-off roller 14, which surface is acted upon by suction and is air-permeable, causes the fibre tuft to be deposited, stretched-out, on the take-off roller 14. The fibre tufts are placed one on top of the other, overlapping in the manner of roof tiles, and form a web 17 of fibre portions $\mathbf{30}_4$.

Web Removal and Comber Sliver Formation

The web 17 is removed from the take-off roller 14 at a point on the take-off roller not acted upon by suction and is guided into a funnel 34.

Comber Sliver Procedure

The resulting comber sliver can be doubled and drafted (drafting system 50) and is then deposited, for example, in a can 3*b* or (not shown) in the form of a can-less fibre sliver bundle, by means of coiler 3*a*.

In the embodiment of FIG. 6, the piecing roller 14 is mounted on a concentric path with respect to the axle of the roller 13 (combing rotor roller). For that purpose, two rotary lever-like retaining elements 36*a*, 36*b* (only 36*a* is shown) are provided, one end 36' of which is associated, forming a bearing, with the axle of the piecing roller 14 and the other end 36" of which is associated, forming a bearing, with the axle of the roller 14. The distance a between the cylindrical surface of the piecing roller 14 and the cylindrical surface of the roller 13 (comber rotor) is adjustable (in a manner not shown). The lever elements 36*a*, 36*b* are rotatable in directions Q, R around the axle of the roller 13.

As FIGS. 4*a*, 4*b* and 7*a*, 7*b* show, the combed fibre bundles $\mathbf{30}_4$ are placed one on top of the other, overlapping (piecing operation). The overlap length $I_1$ and $I_2$ is, according to FIGS. 7*a*, 7*b*, on the one hand, and FIGS. 7*c*, 7*d*, on the other hand, dependent on the relative speed between piecing roller 14 and roller 13 (combing rotor). By varying the overlap length, the web weight and the evenness (CV values) can be changed. This can be effected, for example, in conformity with the material.

In the embodiments of FIGS. 8 and 9, web-consolidation elements co-operate with the piecing roller 14. The web-consolidation elements are positioned between the transfer point from combing rotor 13 to the piecing roller 14 and the transfer point from the piecing roller 14 to the point at which the material $\mathbf{30}_4$ is taken down from the piecing roller 14. One or more web-consolidation elements may be used. When a plurality of web-consolidation elements are used, for example, the spacing of the elements with respect to the piecing roller 14 can decrease continuously in the direction of flow of the material. The configuration of the web-consolidation elements may be different. For example, pressure-applying rollers 37, 38 (FIG. 8) or revolving belts 39 (FIG. 9) may be used. The surface of the web-consolidation elements may be differently configured. For example, clothings, milled or rubberized surfaces or solid rollers may be used. The web-consolidation elements have the same speed as the piecing roller 14.

In the embodiment of FIG. 10, covering elements 40, 41 (casings) are provided at the outer cylindrical surface of the piecing roller 14. The covering elements 40, 41 (casings) can be positioned, for example, in the reduced pressure region, in order to reduce the volume of air required. The covering elements 40, 41 (casings), or parts of the casings, can be of antistatic construction. Furthermore, air guide elements 42, 43 are provided at the outer cylindrical surface of the piecing roller. The air guide elements 42, 43 can be mounted, for example, in the nip region between combing rotor 13 and piecing roller 14. Alternatively, they can be arranged at different points around the periphery of the piecing roller, at the point at which the material is taken down from the piecing roller or between the covering elements 40, 41 and the piecing roller. The reference numeral 63 indicates a screen element and 64 a take-off roller.

The removal of the material $\mathbf{30}_4$ from the piecing roller 14 can be effected by any suitable means, for example, via strippers or blades (not shown), by means of a roller pair 44*a*, 44*b* (FIG. 11), by means of a reduced pressure roller (not shown), by means of a roller 45 with a defined clamping line F (FIG. 12, e.g. spring-loaded) with respect to the piecing roller 14, by means of an increased pressure region 46 (FIG. 13) in the piecing roller, or by means of nozzles 47 (FIG. 14) through which air flows, by means of which the web is separated from the piecing roller 14.

The use of a roller 45 with a defined clamping line for removal of the material $\mathbf{30}_4$ allows screen elements in the inner cylindrical surface of the piecing roller 14 to be dispensed with.

The covering elements 40, 41, air guide elements 42, 43, screen elements 33 and web-bonding elements 37, 38, 39 are exchangeable and adjustable as regards their position with respect to the piecing roller 14.

In the embodiment of FIG. 15, the piecing element is in the form of a perforated conveyor belt 48, which is connected to a source of reduced pressure and includes four belt guide rollers 49*a*-49*d*. Depending on the geometrical configuration of the conveyor belt 48, the removal region can be positioned closer to the combing rotor 13 than when using a piecing roller 14. Depending on the geometrical configuration of the conveyor belt 48, a longer transfer region between combing rotor 13 and conveyor belt 48, which is used as piecing element, can be implemented. This is facilitated, for example, when two belt guide rollers 49*a*, 49*b* positioned at the rotor periphery (periphery of the roller 13) are used.

A drafting system 50 may be arranged downstream of the piecing roller 14 (see FIG. 2). The drafting system 50 can be regulated or unregulated. A web or a sliver can be drawn.

A device for extending the width of the web with the aim of reducing the grammage can be inserted upstream of the drafting system. Correspondingly, a device for extending the width of the sliver with the aim of reducing the grammage of the sliver can be inserted upstream of the drafting system 50. In addition, a sliver-forming device 34 (FIG. 4*a*) and a sliver-deposition device 3 (FIG. 1) can be arranged downstream of the piecing roller 14.

FIG. 16 shows a rotor combing machine which is generally similar to the embodiment of FIG. 2. Suction devices are associated with the clamping devices 18 of the first roller (12) and with the clamping devices 21 of the second roller 13 respectively. According to FIG. 16, the rotatably mounted rollers 12 and 13 with clamping devices 19, 20 and 22, 23 respectively are additionally fitted with suction openings 52 and 56 respectively (also referred to as suction channels) which, in the region of the delivery between the supply device 8 and the roller 12 and in the region of the delivery between the rollers 12 and 13, influence the alignment and movement of the fibres being transported. In that way, the time for the taking up of the fibre material from the supply device 8 onto the first roller 12 and the delivery from the first roller 12 onto the second roller 13 is significantly reduced, so that the nip rate can be increased. The suction openings 52, 56 are arranged within the rollers 12 and 13, respectively, and rotate with the rollers. At least one suction opening is associated with each clamping device 19, 20 and 22, 23 (nipper device). The suction openings 52, 56 are each arranged between a gripping element (upper nipper) and counter-element (lower nipper). In the interior of the rotors 12, 13 there is a reduced pressure region 53 to 55 and 57 to 59, respectively, created by the suction flow B at the suction openings 52, 56. The reduced pressure can be generated by connecting to a flow-generating machine. The suction flow B at the individual suction openings 52, 56 can be so switched between reduced pressure region and suction opening that it is applied only at particular selected angular positions on the roller periphery. For the purpose of the switching, valves or a valve pipe 54, 58 with openings 55 and 59, respectively, in the corresponding angular positions can be used. The release of the suction flow B may also be brought about by the movement of the gripping element (upper nipper). Furthermore, it is possible to arrange a region of reduced pressure only at the corresponding angular positions.

Additionally, a flow of blown air can be provided in the region of the supply device 8 and/or in the region of transfer between the rollers. The source of the flow of blown air (blowing nozzle 39) is arranged inside the feed roller 10 and acts, through the air-permeable surface of the supply device or through air passage openings, towards the outside in the direction of the first roller. Also, in the region of the supply device 8, the element for producing the blown air current can be fixedly arranged, directly under or over the supply device 8. In the region of the transfer between the rollers 12, 13 the blown air current sources can be arranged at the rotor perimeter of the first roller 12, directly under or over each nipper device. For the blown air generation there may be used compressed air nozzles and/or air blades.

The suction flow B can favourably influence and shorten not only the guiding, but also the separation process between the lap and the tufts to be removed in the region of the supply device 8.

As a result of the provision of additional air guide elements 60 and lateral screens 61, 62 the direction of the flow can be influenced and the air carried round with the rotors separated off. In that way, the time for set up can be further shortened. In particular, a screen element between the first rotor 12 and supply device 8 over the lap and a screen element on each side of the roller have proved useful.

The combed-out fibre portion $\mathbf{30}_3$ passes from the second roller 13 onto the piecing roller 14.

In the embodiment of FIG. 17, clamping elements 66 are present at the first roller 65 (turning rotor), opposite which a conveyor belt 67 is arranged as counter-element, and in which the fibre sliver is held by suction on the first roller 65.

The fibre material is fed by a supply device 68 comprising two co-operating endlessly revolving conveyor belts 68*a*, 68*b* into the gap between the roller 65 and the conveyor belt 67. Through clamping between the clamping elements 66 and the belt portion 67*a* of the conveyor belt 67 facing towards the roller 65, fibre sliver bundles are formed and carried out of the gap between the roller 65 and the conveyor belt 67. Subsequently an end region of each sliver bundle 30 is firmly held on the surface of the roller 65 by a suction air current L of a suction channel 69, which is connected to an underpressure region 70. The fibre bundle 30 is subsequently transferred onto the second roller 13, (combing rotor), which is illustrated in FIG. 16. The combed-out fibre material passes from the second roller 13 onto the piecing roller 14.

In the embodiment of FIG. 18, a first roller 12 (turning rotor) is provided, which is illustrated in FIG. 16. The fibre bundle 30 is transferred from the first roller 12 onto a second roller 71 (combing rotor), which rotates in a direction 71*a*. Inside the second roller 71, a further roller 72 equipped with a plurality of combing elements 73 rotates. The roller 72 is mounted concentrically with respect to the axis of the second roller 71. The roller 72 rotates continuously and uniformly in the same direction as or in the opposite direction to the combing rotor 71. The nipper devices 74 consist of an upper nipper 75 and a lower nipper 76, which with their one end are rotatable in directions M, N about a pivot bearing 77. In the closed state, the nipper devices 74 present the clamped fibre tufts to the combing elements 73 for combing. Through the relative movement between fibre tuft and combing element 73 the fibre tuft is combed out. Inside the rotor 71 there is a cleaning device, for example, a rotating cleaning roller 78, which cleans the combing elements 73. In the case of same-direction combing, the speed ratio between combing rotor 71 and the roller 72 with combing elements 73 is greater than 1. The combed-out fibre bundle passes from the combing rotor 71 onto the piecing roller 14.

The circumferential speeds are, for example, for the feed roller about from 0.2 to 1.0 m/sec; the first roller 12 about from 2.0 to 6.0 m/sec; the second roller 13 about from 2.0 to 6.0 m/sec; the doffer about from 0.4 to 1.5 m/sec; and the revolving card top assembly about from 1.5 to 4.5 m/sec. The diameter of the first roller 12 and the second roller 13 is, for example, about from 0.3 m to 0.8 m.

Using the rotor combing machine 2 according to the invention, more than 2000 nips/min, for example from 3000 to 5000 nips/min, are achieved.

Using the rotor combing machine according to the invention there is achieved a mechanical combing of the fibre material to be combed out, that is, mechanical means are used for the combing. There is no pneumatic combing of the fibre material to be combed, that is, no air currents, e.g. suction and/or blown air currents, are used for combing.

In the rotor combing machine according to the invention there are present rollers that rotate rapidly without interruption (continuously) and that have clamping devices. Rollers that rotate with interruptions, stepwise or alternating between a stationary and rotating state are not used.

Although the foregoing invention has been described in detail by way of illustration and example for purposes of understanding, it will be obvious that changes and modifications may be practised within the scope of the appended claims.

What we claim is:

1. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of textile fibers at a clamping site located at a distance from a free end of the bundle;

a supply device adapted to supply the fibre bundle to the fibre-sorting device, wherein the fibre-sorting device is arranged downstream of the supply device;

at least one mechanical device adapted to generate a combing action from the clamping site to the free end of the fibre bundle, wherein the at least one mechanical device is associated with at least one of the first and second rollers; and a piecing arrangement adapted to remove the combed fibre bundles comprising a revolving element, wherein the piecing arrangement is adapted to release the clamping of the clamped ends of the combed fibre bundles after take-up of the free ends of the combed fibre bundles by the revolving element, and wherein the point in time of termination of the clamping forces on the fibre bundle is adjustable.

2. An apparatus according to claim 1, further comprising a control arrangement that is adapted to control and adjust at least one of the speed of rotation of the revolving element and the speed of rotation of the rollers with the clamping devices.

3. An apparatus according to claim 1, wherein the delivery of the fibre bundles from the clamping devices of the fibre-sorting device and the take-up of the fibre bundles onto the revolving element are synchronized.

4. An apparatus according to claim 1, wherein a relative rotational movement between clamping devices and fibre bundle does not begin until after the fibre bundle has been taken up by the revolving element and the clamping has been terminated.

5. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of textile fibers at a clamping site located at a distance from a free end of the bundle;

a supply device adapted to supply the fibre bundle to the fibre-sorting device, wherein the fibre-sorting device is arranged downstream of the supply device;

at least one mechanical device adapted to generate a combing action from the clamping site to the free end of the fibre bundle, wherein the at least one mechanical device is associated with at least one of the first and second rollers; and a piecing arrangement adapted to remove the combed fibre bundles comprising a revolving element, wherein the piecing arrangement is adapted to release the clamping of the clamped ends of the combed fibre bundles after take-up of the free ends of the combed fibre bundles by the revolving element, and wherein the revolving element comprises a surface that contains air passage openings and an inner space having at least a part that is maintainable at a reduced pressure with respect to the pressure outside the revolving element.

6. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of textile fibers at a clamping site located at a distance from a free end of the bundle;

a supply device adapted to supply the fibre bundle to the fibre-sorting device, wherein the fibre-sorting device is arranged downstream of the supply device;

at least one mechanical device adapted to generate a combing action from the clamping site to the free end of the fibre bundle, wherein the at least one mechanical device is associated with at least one of the first and second rollers; and a piecing arrangement adapted to remove the combed fibre bundles comprising a revolving element, wherein the piecing arrangement is adapted to release the clamping of the clamped ends of the combed fibre bundles after take-up of the free ends of the combed fibre bundles by the revolving element, wherein the revolving element comprises a piecing roller that is rotatably mounted axially parallel to the rollers of the fibre-sorting device, and wherein the piecing roller is further adjustably mounted on a concentric path with respect to the axis of the adjacent roller of the fibre-sorting device.

7. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of textile fibers at a clamping site located at a distance from a free end of the bundle;

a supply device adapted to supply the fibre bundle to the fibre-sorting device, wherein the fibre-sorting device is arranged downstream of the supply device;

at least one mechanical device adapted to generate a combing action from the clamping site to the free end of the fibre bundle, wherein the at least one mechanical device is associated with at least one of the first and second rollers; and a piecing arrangement adapted to remove the combed fibre bundles comprising a revolving element, wherein the piecing arrangement is adapted to release the clamping of the clamped ends of the combed fibre bundles after take-up of the free ends of the combed fibre bundles by the revolving element, and wherein the direction of rotation of the revolving element can be set in the same direction as or counter to the adjacent roller of the fibre-sorting device.

8. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of textile fibers at a clamping site located at a distance from a free end of the bundle;

a supply device adapted to supply the fibre bundle to the fibre-sorting device, wherein the fibre-sorting device is arranged downstream of the supply device;

at least one mechanical device adapted to generate a combing action from the clamping site to the free end of the fibre bundle, wherein the at least one mechanical device is associated with at least one of the first and second rollers; and a piecing arrangement adapted to remove the combed fibre bundles comprising a revolving element, wherein the piecing arrangement is adapted to release the clamping of the clamped ends of the combed fibre bundles after take-up of the free ends of the combed fibre bundles by the revolving element, wherein the piecing arrangement is configured such that the combed fibre bundles are overlapping on the revolving element of the piecing arrangement, the overlap length being adjustable dependent on the relative speed between the revolving element of the piecing arrangement and the adjacent roller of the fibre-sorting device, and wherein the revolving element comprises a piecing roller and a portion of the inner circumferential surface of the piecing roller is sealable by at least one screen element.

9. An apparatus according to claim 1, further comprising one or more web-consolidating elements that co-operate with the revolving element.

10. An apparatus according to claim 9, wherein at least one web-consolidating element comprises at least one of a rotatable pressure-applying roller, a revolving belt, a clothed web-consolidating element, a profiled web-consolidating element, a rubberised web-consolidating element, and a solid roller.

11. An apparatus according to claim 10, wherein the at least one web-consolidating element has the same circumferential speed as the piecing roller.

12. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of textile fibers at a clamping site located at a distance from a free end of the bundle;

a supply device adapted to supply the fibre bundle to the fibre-sorting device, wherein the fibre-sorting device is arranged downstream of the supply device;

at least one mechanical device adapted to generate a combing action from the clamping site to the free end of the fibre bundle, wherein the at least one mechanical device is associated with at least one of the first and second rollers; and a piecing arrangement adapted to remove the combed fibre bundles comprising a revolving element, wherein the piecing arrangement is adapted to release the clamping of the clamped ends of the combed fibre bundles after take-up of the free ends of the combed fibre bundles by the revolving element, and wherein the revolving element comprises a piecing roller having an outer cylindrical surface including covering elements or casings, positioned, in order to reduce the volume of air required, in a region in which the inside of the piecing roller is subject to reduced pressure.

13. An apparatus according to claim 12, wherein the outer cylindrical surface of the piecing roller includes air guide openings.

14. An apparatus according to claim 1, further comprising at least one of a sliver-forming device and a drafting device that is arranged downstream of the piecing arrangement.

15. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of textile fibers at a clamping site located at a distance from a free end of the bundle;

a supply device adapted to supply the fibre bundle to the fibre-sorting device, wherein the fibre-sorting device is arranged downstream of the supply device;

at least one mechanical device adapted to generate a combing action from the clamping site to the free end of the fibre bundle, wherein the at least one mechanical device is associated with at least one of the first and second rollers; and a piecing arrangement adapted to remove the combed fibre bundles comprising a revolving element, wherein the piecing arrangement is adapted to release the clamping of the clamped ends of the combed fibre bundles after take-up of the free ends of the combed fibre bundles by the revolving element, and wherein the revolving element comprises a perforated conveyor belt and is connected to a source of suction.

16. An apparatus according to claim 1, wherein the free ends of the combed fibre bundles are aligned in the direction of rotation of the revolving element.

17. An apparatus according to claim 1, wherein the free ends of the combed fibre bundles are aligned against the direction of rotation of the revolving element.

18. An apparatus according to claim 1, wherein the first roller and the second roller comprise at least one turning rotor and at least one combing rotor, which have opposite directions of rotation.

19. An apparatus for the fibre-sorting or fibre-selection of a fibre bundle comprising textile fibres, the apparatus comprising:

a fibre-sorting device comprising at least a first roller and a second roller that, in use, rotate rapidly without interruption, and clamping devices distributed spaced apart about a periphery of at least one of the first and second rollers, each clamping device adapted to clamp a bundle of textile fibers at a clamping site located at a distance from a free end of the bundle;

a supply device adapted to supply the fibre bundle to the fibre-sorting device, wherein the fibre-sorting device is arranged downstream of the supply device;

at least one mechanical device adapted to generate a combing action from the clamping site to the free end of the fibre bundle, wherein the at least one mechanical device is associated with at least one of the first and second rollers;

a piecing arrangement adapted to remove the combed fibre bundles comprising a revolving element, wherein the piecing arrangement is adapted to release the clamping of the clamped ends of the combed fibre bundles after take-up of the free ends of the combed fibre bundles by the revolving element; and at least one suction device associated with the clamping devices in at least one of a region of transfer of the fibre bundles from the supply device to the first roller and a region of transfer of the fibre bundles from the first roller to the second roller, wherein the suction device generates a suction air current that acts on the fibre bundles during transfer before clamping by the clamping devices.

* * * * *